US010364816B2

(12) United States Patent
Nofal et al.

(10) Patent No.: US 10,364,816 B2
(45) Date of Patent: Jul. 30, 2019

(54) REMOTE PUMP MANAGING DEVICE

(71) Applicant: Lincus, Inc., Tempe, AZ (US)

(72) Inventors: Jorj Nofal, Phoenix, AZ (US); Luke Drake, Mesa, AZ (US); Keith Tonkinson, Queen Creek, AZ (US)

(73) Assignee: Lincus, Inc., Tempe, AZ (US)

( * ) Notice: Subject to any disclaimer, the term of this patent is extended or adjusted under 35 U.S.C. 154(b) by 24 days.

(21) Appl. No.: 15/414,893

(22) Filed: Jan. 25, 2017

(65) Prior Publication Data

US 2018/0209430 A1 Jul. 26, 2018

(51) Int. Cl.

| | |
|---|---|
| ***F04D 27/00*** | (2006.01) |
| ***F04B 51/00*** | (2006.01) |
| ***F04B 17/03*** | (2006.01) |
| ***F04B 23/04*** | (2006.01) |
| ***F04B 49/06*** | (2006.01) |
| ***F04D 15/00*** | (2006.01) |

(52) U.S. Cl.

CPC ..... *F04D 27/001* (2013.01); *F04B 17/03* (2013.01); *F04B 23/04* (2013.01); *F04B 49/065* (2013.01); *F04B 51/00* (2013.01); *F04D 15/0088* (2013.01); *F04B 2203/0208* (2013.01); *F04B 2205/01* (2013.01); *F04B 2205/05* (2013.01); *F04B 2205/09* (2013.01)

(58) Field of Classification Search

CPC ..... F04D 27/001; F04B 51/00

See application file for complete search history.

(56) References Cited

U.S. PATENT DOCUMENTS 4,107,987 A 8/1978 Robbins et al.
4,473,338 A 9/1984 Garmong
(Continued)

FOREIGN PATENT DOCUMENTS

CN 201826893 U 5/2011
CN 2031010941 U 7/2013
(Continued)

OTHER PUBLICATIONS

Hyundai Kefico Corp, Device for testing capability of depressurization valve. Jun. 20, 2017, Derwent.*
(Continued)

*Primary Examiner* — Francis C Gray
(74) *Attorney, Agent, or Firm* — Schmeiser, Olsen & Watts LLP

(57) ABSTRACT

A remote pump manager is provided. The remote pump manager includes pressure sensors or a depth sensor operating to determine the change in pressure of a pump, a flow sensor operating to determine flow rate of fluid exiting the pump, a power meter operating to determine power data related to operation of the pump, and a management device having a programmable logic controller and a display. The pressure sensors, the flow sensor and the power meter are in communication with the management device. The management device operates to determine pump efficiencies, wherein the programmable logic controller automatically determines pump efficiency data in response to receiving real time data from the pressure sensors, the flow sensor and the power meter and automatically delivers the pump efficiency data to the display for displaying the determined pump efficiency data.

11 Claims, 4 Drawing Sheets

(56) References Cited

U.S. PATENT DOCUMENTS

| | | | | |
|---|---|---|---|---|
| 5,281,100 | A * | 1/1994 | Diederich | E21B 43/127 417/18 |
| 5,291,777 | A | 3/1994 | Chang et al. | |
| 5,864,183 | A * | 1/1999 | Fisher, Jr. | F03B 13/06 290/40 C |
| 6,167,965 | B1 * | 1/2001 | Bearden | E21B 43/121 166/105.5 |
| 9,013,322 | B2 | 4/2015 | Roberson et al. | |
| 9,080,438 | B1 | 7/2015 | McCoy et al. | |
| 2004/0167738 | A1 * | 8/2004 | Miller | F04B 51/00 702/114 |
| 2008/0190604 | A1 | 8/2008 | Hild et al. | |
| 2011/0051297 | A1 * | 3/2011 | Knox | E21B 47/0007 361/23 |
| 2015/0308242 | A1 | 10/2015 | Suprick et al. | |
| 2016/0108715 | A1 * | 4/2016 | Haines | E21B 41/00 348/85 |
| 2017/0069070 | A1 * | 3/2017 | Seely | G06T 7/001 |

FOREIGN PATENT DOCUMENTS

| | | | | |
|---|---|---|---|---|
| CN | 203311247 | U | | 11/2013 |
| CN | 104898579 | A | | 9/2015 |
| CN | 105028136 | A | | 11/2015 |
| KR | 2017-47548 | H | * | 6/2017 |
| RU | 2008-O15176 | | * | 12/2008 |

OTHER PUBLICATIONS

St Petersburg Plekhanov Mining Inst, Automated data system for control and monitoring of heating boiler-house with hot-water boilers operation, Dec. 10, 2008, Derwent.*

* cited by examiner

REMOTE PUMP MANAGING DEVICE

BACKGROUND OF THE INVENTION

Technical Field

This invention relates generally to management of a pump and more particularly to a remote pump manager.

State of the Art

Pumps are used for pumping water, oil and liquids and for other purposes. In general, systems that utilize pumps, particularly water pumps, do not actively monitor the pumps. In many cases, as long as a pump is working, the pump is largely ignored. This leads to lower average Overall Pumping Efficiency ("OPE"). Pump owners rarely perform periodic pump tests, resulting in vast energy waste.

SUMMARY OF THE INVENTION

An embodiment includes a remote pump manager comprising: pressure sensors or a depth sensor operating to determine the change in pressure of a pump; a flow sensor operating to determine flow rate of fluid exiting the pump; a power meter operating to determine power data related to operation of the pump; and a management device having a programmable logic controller and a display, the pressure sensors, the flow sensor and the power meter in communication with the management device, and wherein the management device operates to determine pump efficiencies, wherein the programmable logic controller automatically determines pump efficiency data in response to receiving real time data from the pressure sensors, the flow sensor and the power meter and automatically delivers the pump efficiency data to the display for displaying the determined pump efficiency data. The remote pump manager may include a modem in the management device for sending the real time data to a remote server.

Another embodiment includes a remote pump manager comprising: a management device having a programmable logic controller and a display, the management device operatively coupled to a pump wherein: the management device operates at predetermined intervals to determine pump efficiencies; the programmable logic controller, during operation of the management device, automatically determines pump efficiency data in response to receiving real time pressure data, real time flow data and real time power data; and the programmable logic controller, during operation of the management device, automatically delivers the pump efficiency data to the display for displaying the determined pump efficiency data.

Yet another embodiment includes a method of operating a remote pump manager, the method comprising: coupling a management device to at least one pump; sending pressure data of the at least one pump to the management device; sending flow data of the at least one pump to the management device; sending power data of the at least one pump to the management device; and automatically determining pump efficiency data of the at least one pump and delivering the pump efficiency data to a display of the management device for displaying the pump efficiency data. Determining the pump efficiency data comprises operating a programmable logic controller of the management device to determine pump efficiency utilizing the pressure data, the flow data, and the power data.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a remote pump manager. The remote pump manager provides an efficient, reliable, pump monitoring system at an affordable cost. The remote pump manager may stream live data from the site via sensors. This data may be collected for determination of insightful calculations of pump efficiency, as well as energy use. In addition to monitoring, the remote pump manager may also include a management program that can control basic pump functions remotely.

Figure 1:
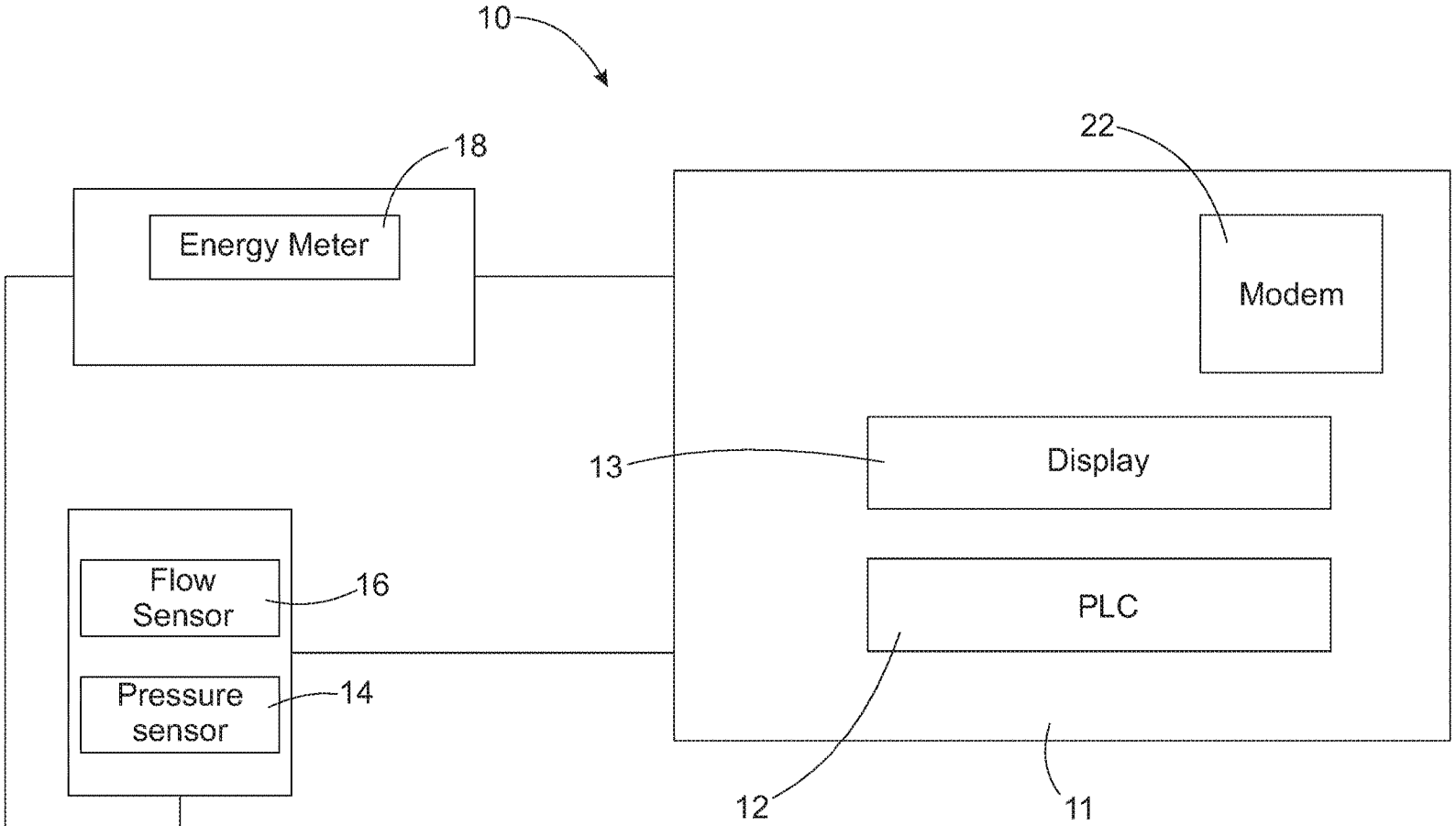
FIG. 1 is a schematic view of a management device of a remote pump manager, in accordance with some embodiments.
Figure 2:
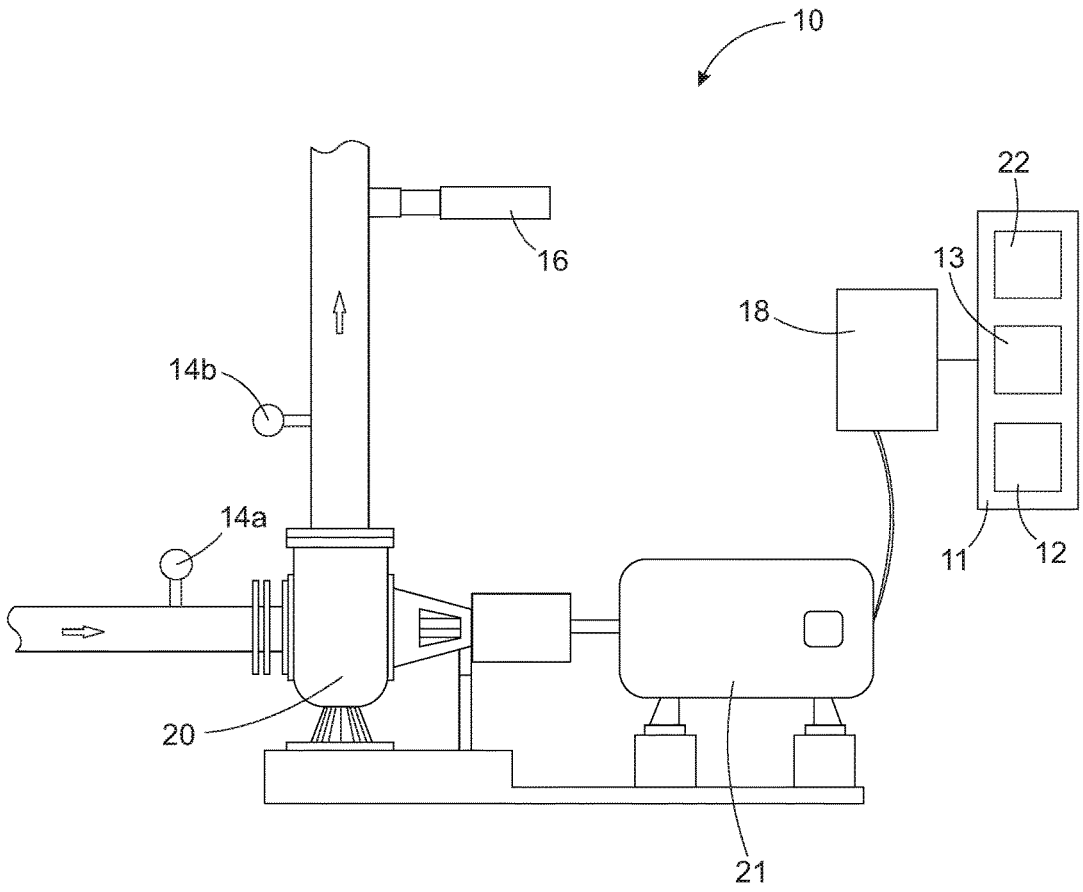
FIG. 2 is a view of a pump with a remote pump manager, in accordance with some embodiments.

FIGS. 1 and 2 depict a remote pump manager 10 according to an embodiment of the present invention. The remote pump manager 10 includes a management device 11 comprising programmable logic controller ("PLC") 12 and a display 13, at least one pressure sensor 14, a flow sensor 16, and a power meter 18. The management device 11 may include a modem 22. The remote pump manager 10 may include a pump 20.

Referring specifically to FIG. 2, the remote pump manager 10 comprises the PLC 12, the display 13, a first pressure sensor 14*a*, a second pressure sensor 14*b*, the flow sensor 16, the power meter 18, the pump 20 and the modem 22. The first pressure sensor 14*a* is coupled to a pipe flowing into the pump 20 and the second pressure sensor 14*b* is coupled to a pipe flowing out of the pump 20. The flow meter is coupled to the pipe flowing out of the pump 20. The power meter 18 is coupled to a motor 21 that supplies power to the pump 20. The management device 11 may be in communication with the first pressure sensor 14*a*, the second pressure sensor 14*b*, the flow sensor 16, and the power meter 18.

The management device 11 operates to determine pump efficiencies. This occurs by the PLC 12 automatically determining pump efficiency data in response to receiving real time data from the first pressure sensor 14*a*, the second pressure sensor 14*b*, the flow sensor 16 and the power meter 18. The PLC 12 utilizes the measurement of flow, differential pressure, and power to determine pump efficiency.

The flow sensor 16 may be a paddlewheel flow type sensor that works for a large range of pipe diameters and flow rates. The flow sensor 16 may be a clamp on ultrasonic flow meter has the benefit of easy installation, and wide range of use. The flow sensor 16 may be any other type of flow meter.

Measuring pressure may require a simple pressure transmitter on the suction (first pressure sensor 14*a*) and discharge (second pressure sensor 14*b*) of the pump 20. In some embodiments, however, it may be difficult to install a pressure transmitter on the suction side of the pump 20. This difficulty arises when the pipe comes directly from the ground into the pump 20, such as but not limited to a well pump, with no straight section for a low turbulence measurement. In these embodiments, the physical parameters of the system will be used to determine suction head using a head sensor or a depth sensor. The suction pressure/head sensor is dependent on the location of the water source. If the water source is above the pump centerline, then the suction head will be a positive number. If the water source is below the center line, the suction head is a negative number. This can be combined with the discharge head to find the total dynamic head. The total dynamic head data may operate as pressure data or be used with the efficiency calculation performed by the PLC 12.

The remote pump manager 10 may operate to monitor power, energy, and power factor by use of a power meter 18. While power is a direct factor on pump efficiency, the other quantities are useful for cost analysis. The power meter 18 may measure voltage and current inputs and then return energy use. To work, the meter 18 may require current transformers (CTs) to measure the current. Split core CTs are preferred due to their installation requirements. The CTs output a standard 0-5A, which the meter combines with the voltage reading to yield energy use. Specifically, the meter 18 finds active power, reactive power, and apparent power. The power meter 18 may also convert these power readings into energy readings by factoring for time.

The PLC 12 operates to determine pump efficiency. The method uses Bernoulli's equations to find pump efficiency. Sensors find flow, pressure difference across the pump, and energy consumption by the motor. These quantities, along with constants specific to a pump, provide the necessary information to properly find pump efficiency. The calculations include:

$$\text{(i)}\ Ef = \eta_{pump} = \frac{\text{Water Horsepower}}{\text{Brake Horsepower}} = \frac{WHP}{BHP}$$

$$\text{(ii)}\ WHP = \rho g Q H = \frac{QH}{3956}$$

$$\text{(iii)}\ BHP = HP_{in} \cdot \eta_{motor}$$

$$\text{(iv)}\ H = \Delta Z + h_f + \frac{P_2 - P_1}{\rho g} + \frac{V_2^2 - V_1^2}{2g}$$

$$\text{(v)}\ \eta_{pump} = \frac{Q * \left(\Delta Z + h_f + \frac{P_2 - P_1}{\rho g} + \frac{V_2^2 - V_1^2}{2g}\right)}{\text{kW}/.746 * \eta_{motor}}$$

Equation (v) is the form used to find efficiency, wherein all variables in equation (v) are known, constant, or sensor measured.

A simplified formula may be used by the PLC 12 for calculating efficiency of the pump 20 may be:

$$\text{(vi)}\ Ef = \eta_{pump} = \frac{QH}{3956 * HP}$$

For equations (i)-(vi) the following is a description of variables of the equations and how the variables are obtained:

| | | |
|---|---|---|
| ΔZ | Change in height between pressure measurements | Measured once, Constant |
| $h_f$ | Friction Loss | Measured once, Constant |
| V | Velocity | Derived from Flow and Pipe Diameter |
| ρ | Fluid Density | Known Constant |
| g | Acceleration due to Gravity | Known Constant |
| Q | Flow Rate | Sensor Measured |
| H | kW/.746 | Sensor Measured |
| P | | |
| P | Pressure | Sensor Measured |

Once the PLC 12 determines the pump efficiency data, that pump efficiency data is sent to the display 13 and the display 13 operates to display the pump efficiency data for a user to view and operate the pump 20 in accordance with the pump efficiency data.

For purposes of this disclosure and by way of example only, the pressure sensors 14, flow sensor 16, and power meter 18 must use some form of an electrical signal to transmit data. The signals may be analog or digital. Analog signals involve some form of differential measurement whereas digital signals are of the form on or off. Analog signals have an advantage because they can be transmitted in a variety of ways. There are two predominant methods of analog signaling, namely differential voltage 0-10V, and 4-20 mA current loop. Both signals have useful functions. In the voltage method, a sensor modulates its internal resistance to produce different voltage drops. A data recording device then measures the voltage drop across the sensor and works out what the resistance is. Each resistance value corresponds to an analog value that is programmed within the data recorder. The current loop functions in a very similar fashion but has a subtle difference. It again modulates its internal resistance, but does so to produce different currents in the current loop. The data recorder has an internal resistor of a known value. By recording the voltage drop across the resistor, the current flowing through it is apparent. This current corresponds with a unique sensor value.

Voltage signals are useful because the hardware is very simple, and the measurement is excessively easy to make. The voltage signal suffers in that it is easily affected by field noise and interference. The voltage signal also drops, or decays, over long distances due to the internal resistance of the wires. The current loop avoids these problems, at a slightly higher cost. The current will not change as the signal is carried along longer wires. The current along any circuit loop is constant as defined by Kirchhoff's Current Law. This allows current signals to be carried for much greater distances without any loss in quality. As mentioned above, the current loop requires an additional resistor within the data recorder so that it may interpret the current value. Either analog signal may be utilized with a remote pump manager 10.

The modem 22 of the management device 11 communicates the real time data from the pressure sensors 14, the flow sensor 16 and the power meter 18 to a server (not shown). The server automatically determines pump efficiency data in response to receiving real time data from the pressure sensors 14, the flow sensor 16 and the power meter 18. In embodiments, the PLC 12 interrupts the communication between the modem 22 and the server prior to automatically determining pump efficiency data by the PLC 12, thereby allowing communication with the display 13 to provide pump efficiency data. If the modem malfunctions or communication between the modem 22 and the server is lost, the PLC 12 operates to cache or store pressure data, flow data and power data along with the time associated with the data, and once the communication link between the modem 22 and the server is reestablished, the modem may send the stored data to the server for processing. During times when the modem 22 communication link with the server is down, the PLC 12 may still determine pump efficiency and communicate the same to the display 13.

Figure 3:
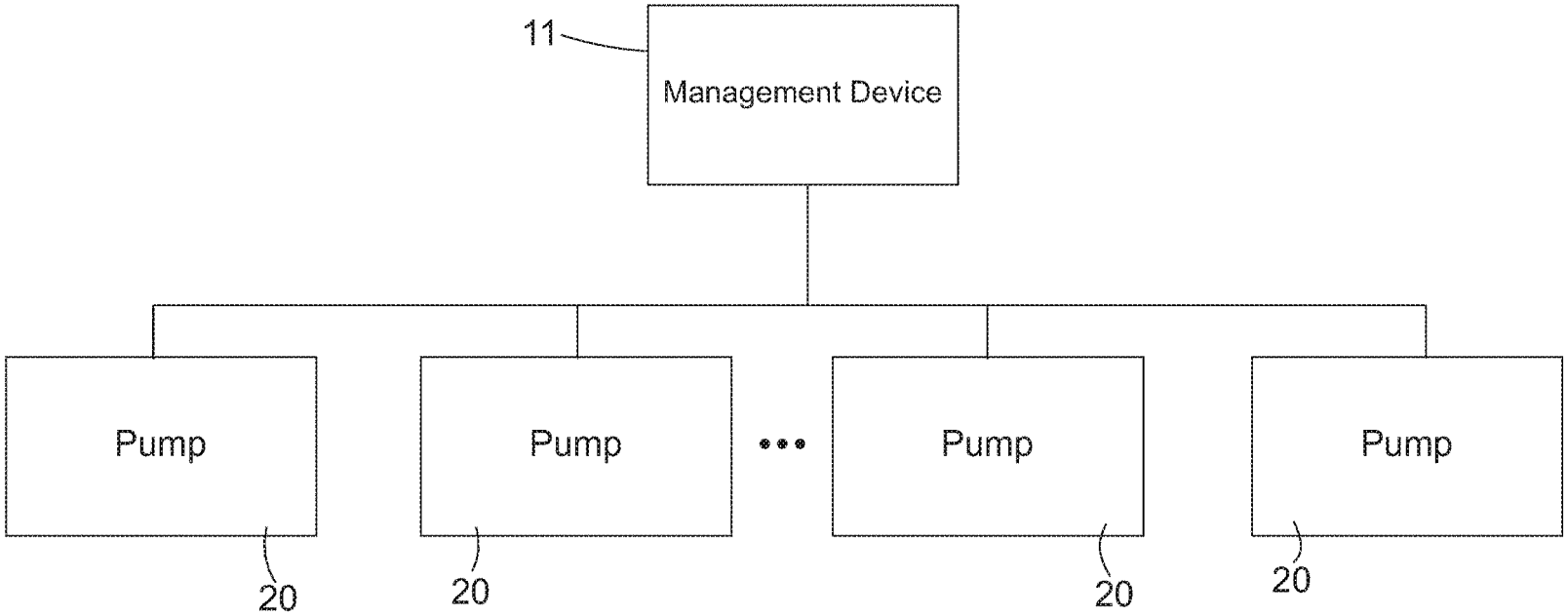
FIG. 3 is a schematic view of a remote pump manager operatively coupled to a plurality of pumps 20.

Referring further to the drawings, FIG. 3 depicts a managing device 11 operating with a plurality of pumps 20. In these embodiments, the pump efficiency is determined for each pump of the plurality of pumps 20 in the manner described above. The pump efficiency data for each pump 20 may be displayed on display 13 in response to the PLC 12 sending the efficiency data for each pump 20 to the display 13. Further, the modem 22 may communicate the pressure data, flow data and power data for each pump 20 of the plurality of pumps to the server wherein the server operates as previously described.

In the embodiments shown in FIGS. 1-3, it will be understood that the server may be programmed to alert a pump owner of the status of each pump 20, and may further provide an alert suggesting certain action or pump control. In some embodiments, the server may be programmed to allow user control of the pumps being monitored by the remote pump manager 10. Further still, the server may be programmed to automatically perform some pump control functions based on the data returned from the remote pump manager 10.

Figure 4:
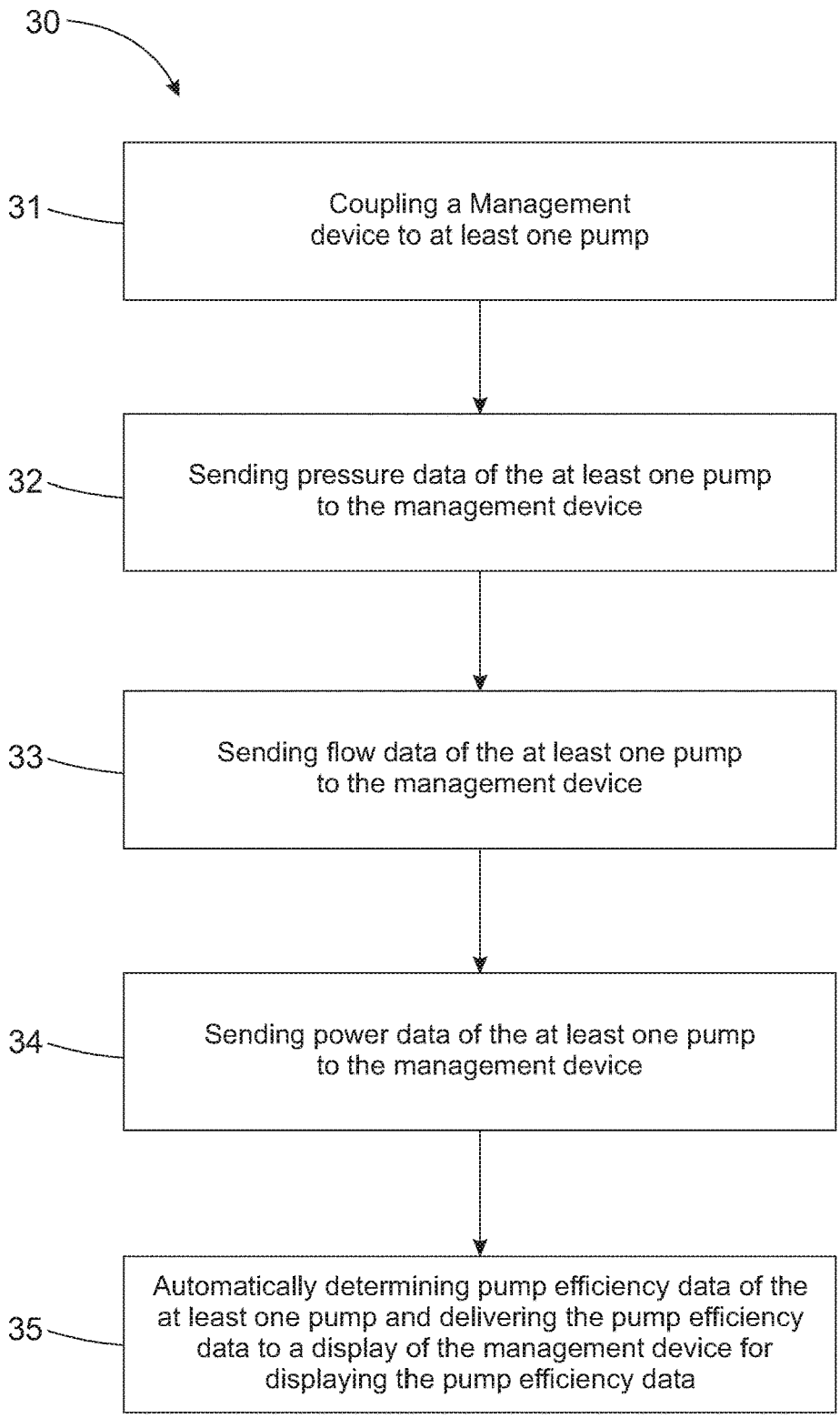
FIG. 4 is a flow diagram of a method of using a remote pump manager, in accordance with some embodiments.

Referring to FIG. 4, another embodiment of the present invention includes a method 30 of using a remote pump manager 10. The method 30 comprises coupling a management device to at least one pump (Step 31); sending pressure data of the at least one pump to the management device (Step 32); sending flow data of the at least one pump to the management device (Step 33); sending power data of the at least one pump to the management device (Step 34); and automatically determining pump efficiency data of the at least one pump and delivering the pump efficiency data to a display of the management device for displaying the pump efficiency data (Step 35).

In method 30, Step 35 of automatically determining pump efficiency data may include operating a programmable logic controller of the management device to determine pump efficiency utilizing the pressure data, the flow data, and the power data. Additionally, the method may include communicating the pressure data, the flow data and the power data to a server. The data may be communicated from sensors as described previously in a manner as described previously.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A remote pump manager comprising:

pressure sensors or a depth sensor operating to determine the change in pressure of a pump;

a flow sensor operating to determine flow rate of fluid exiting the pump;

a power meter operating to determine power data related to operation of the pump;

a management device having a programmable logic controller and a display, the pressure sensors, the flow sensor and the power meter in communication with the management device, and wherein the management device operates to determine pump efficiencies, wherein the programmable logic controller automatically determines pump efficiency data in response to receiving real time data from the pressure sensors, the flow sensor and the power meter and automatically delivers the pump efficiency data to the display for displaying the determined pump efficiency data; and a modem, wherein the modem communicates the real time data from the pressure sensors, the flow sensor and the power meter to a server and the programmable logic controller interrupts the communication from the modem and the server prior to automatically determining pump efficiency data.

2. The remote pump manager of claim 1, wherein the server automatically determines pump efficiency data in response to receiving real time data from the pressure sensors, the flow sensor and the power meter.

3. The remote pump manager of claim 1, wherein the management device operates at predetermined intervals.

4. A remote pump manager comprising:

a management device having a programmable logic controller and a display, the management device operatively coupled to a pump wherein:

the management device operates at predetermined intervals to determine pump efficiencies;

the programmable logic controller, during operation of the management device, automatically determines pump efficiency data in response to receiving real time pressure data, real time flow data and real time power data;

the programmable logic controller, during operation of the management device, automatically delivers the pump efficiency data to the display for displaying the determined pump efficiency data; and a modem in communication with a server; wherein the modem communicates the real time data from the pressure sensors, the flow sensor and the power meter to a server, and wherein the programmable logic controller interrupts the communication from the modem and the server prior to automatically determining pump efficiency data.

5. The remote pump manager of claim 4, further comprising pressure sensors for providing real time pressure data.

6. The remote pump manager of claim 4, further comprising a head sensor for determining the total head of the pump and automatically determining pressure data from the total head of the pump.

7. The remote pump manager of claim 4, further comprising a flow sensor for measuring the flow of fluid leaving the pump.

8. The remote pump manager of claim 4, further comprising a power meter for measuring the power supplied to the pump.

9. The remote pump manager of claim 4, wherein the server automatically determines pump efficiency data in response to receiving real time data from the pressure sensors, the flow sensor and the power meter.

10. The remote pump manager of claim 4, wherein the management device is operatively coupled to a plurality of pumps.

11. The remote pump manager of claim 10, wherein the management device operates at the predetermined intervals to determine pump efficiencies of each of the plurality of pumps.

* * * * *